US005707278A

United States Patent [19]

Korn

[11] Patent Number: 5,707,278

[45] Date of Patent: Jan. 13, 1998

[54] HONING TOOL AND METHOD FOR MANUFACTURING SAME

[75] Inventor: Charles S. Korn, Crestwood, Mo.

[73] Assignee: Sunnen Products Company, St. Louis, Mo.

[21] Appl. No.: 673,895

[22] Filed: Jul. 3, 1996

Related U.S. Application Data

[63] Continuation of Ser. No. 238,434, May 5, 1994, abandoned.

[51] Int. Cl.[6] ..... B24D 9/00; B24D 11/00

[52] U.S. Cl. ..... 451/463; 300/21; 451/466; 451/470; 451/532; 451/540

[58] Field of Search ..... 451/463, 466, 451/470, 532, 540; 300/21

[56] References Cited

U.S. PATENT DOCUMENTS

| | | | |
|---|---|---|---|
| 2,576,546 | 11/1951 | Starr | 300/21 |
| 2,643,158 | 6/1953 | Baldanza | 300/2 |
| 2,664,316 | 2/1953 | Winslow, Jr. et al. | 300/21 |
| 3,053,575 | 9/1962 | Zeilstra | 300/21 |
| 3,471,202 | 10/1969 | Lewis, Jr. | 300/2 |
| 4,462,189 | 7/1984 | Puybaraud | 451/470 |
| 4,635,331 | 1/1987 | Fassler et al. | 15/193 |
| 4,882,879 | 11/1989 | Warner et al. . | |
| 4,945,687 | 8/1990 | Scheider et al. . | |
| 5,127,290 | 7/1992 | Warner et al. . | |
| 5,129,191 | 7/1992 | Warner et al. . | |
| 5,129,197 | 7/1992 | Tyler et al. . | |
| 5,155,945 | 10/1992 | Tyler et al. . | |
| 5,170,593 | 12/1992 | Tyler et al. . | |
| 5,187,904 | 2/1993 | Tyler et al. . | |
| 5,216,847 | 6/1993 | Scheider et al. | 451/463 |
| 5,556,328 | 9/1996 | Scheider et al. | 451/463 |

*Primary Examiner*—Timothy V. Eley
*Attorney, Agent, or Firm*—Haverstock, Garrett and Roberts

[57] ABSTRACT

An improved honing tool including a holder having an open sided cavity located in one side thereof, a sidewall portion extending around at least a portion of the cavity, and one or more elongated filaments of a polymeric material having particles of an abrasive substance dispersed throughout, each of the one or more filaments having an end extending into the cavity, the one or more filament ends being heated sufficiently so as to be softened or melted to conform to the shape of the cavity and intimately engage the sidewall for retaining the one or more filament ends in the cavity. The method for manufacturing the present honing tool includes the steps of applying energy to the holder to heat the holder to a temperature sufficient to soften or melt the one or more filament ends while pressing the filament ends into the cavity so as to conform them to the shape thereof, the holder being preferably heated by induction.

20 Claims, 5 Drawing Sheets

HONING TOOL AND METHOD FOR MANUFACTURING SAME

This application is a continuation of U.S. application Ser. No. 08/238,434, filed May 5,1994 which is now abandoned The present invention relates generally to honing tools utilizing abrasive filaments for honing the surfaces of bores and other workpiece surfaces, and more particularly, to a more effective and longer lasting abrasive filament honing tool and method for manufacturing same. The present honing tool is of the kind including a plurality of discrete abrasive filaments or fibers arranged in generally parallel relation and having corresponding ends thereof retained together in a cavity or receptacle on a holder or support member which is mountable on a honing mandrel. Importantly however, unlike conventional abrasive filament tools which typically utilize means such as an adhesive substance, clamping, crimping or the like for retaining the ends of the abrasive filaments in the holder, the mounting ends of the filaments in the present invention are melted or at least sufficiently softened by heating so as to be formed into a shape which can be retained in the holder by engagement with means on the holder for that purpose. This means of retaining the filaments provides advantages such as increased flexibility and versatility in the possible arrangements of the filaments and number of filaments which can be used, while still providing adequate retention to prevent the loss of the filaments even under extreme honing conditions. Further, since adhesives are eliminated, the present honing tools can be used in environments thermally and chemically hostile to adhesives. The preferred method of forming the abrasive filaments into a retainable shape includes the step of applying energy to the holder or support member such as by induction heating so as to melt or soften only the ends of the abrasive filaments in contact with or adjacent to the holder. Induction heating provides the advantages that it can be precisely controlled, enables using the holder as a mold for shaping the ends of the filaments, and it is a relatively fast, environmentally safe and inexpensive process.

BACKGROUND OF THE INVENTION

Honing is a machining process that utilizes an abrasive medium including a large number of abrasive particles to remove material from a workpiece surface such as the surface of a bore or hole (internal honing), or of a shaft or other external surface (external honing), to achieve such results as improved surface geometry or finish, or to alter the dimensions of the workpiece. The honing process is affected by the relative rotation and reciprocating action between one or more honing tools and a workpiece and by the application of force by the honing tool against the surface of the workpiece to remove material therefrom, typically by the action of a honing machine specifically designed for such purpose and in some cases by hand or other means. A variety of abrasives are used for honing, some of the more common abrasives including particles of silicon carbide, aluminum oxide, diamond and cubic boron nitride. These abrasives are typically embodied in conventional or traditional honing tools which are rigid, hard members and can be used to produce the above-discussed honed characteristics on a wide variety of workpieces.

Abrasive filaments and fibers, in contrast to the more traditional hard or rigid honing members, are generally composed of flexible strands of polymeric material such as nylon or polyester or the like in which the abrasive particles are dispersed throughout. These abrasive filaments provide a much more forgiving honing medium than the more traditional honing members, and a wide variety of abrasive filament having various abrasive compositions suitable for different applications are commercially available.

One application in which abrasive filament honing members are particularly advantageous is known as plateau honing. In plateau honing, an important object is to provide a surface finish similar to a worn surface so as to facilitate the wearing down or breaking in of new parts moving in surface to surface engagement, such as the cylinder walls and rings for internal combustion engines. Plateau honed surfaces on cylinder walls, rings and other surfaces have been found to provide significant reduction in initial wear, an increase in initial load bearing capability, and other advantages when compared to conventionally honed surfaces. Plateau honing is generally a two step operation wherein the first step utilizes a relatively coarse abrasive to remove a large amount of material to shape and size the workpiece surface. The second step utilizes a finer abrasive to remove only a small amount of material to provide the final surface finish similar to that of a worn surface. With the more traditional harder honing tools, this second step must be carefully performed and requires a high level of operator skill and machine precision to avoid removing too much material and altering the shape and size of the surface. In contrast, using abrasive filament honing members, because of their more flexible, forgiving nature, they conform more to the shape of the surface and remove material less aggressively, such that the second step requires much less operator skill and attention to provide the final surface finish. However, the known abrasive filament honing tools which use means such as adhesives, clamping, clinching and the like for retaining the filaments on the holder or support member have been found to be limited in strength and durability under some conditions, and therefore have not been completely satisfactory alternatives for more conventional honing members. Furthermore, the abrasive filament tools which use adhesives as means for attachment cannot be used in certain applications due to chemical and thermal conditions present in the environment. Reference is made to U.S. Pat. No. 5,216,847 which discloses one known abrasive filament honing tool wherein the filaments are secured by means of an adhesive.

SUMMARY OF THE INVENTION

The present invention teaches the construction and operation of an improved abrasive filament honing tool and method for manufacturing same which overcomes many of the above-discussed limitations and shortcomings associated with known abrasive filament honing tools. Importantly, the abrasive filaments according to the present invention have ends located in a holder or support member, which ends instead of being glued, clamped or clinched in place, are melted or softened and formed into a shape that conforms to the shape of means on the holder or support member for retaining the filaments. The abrasive filament honing tools constructed according to the present invention have been found to provide the needed excellent strength and durability over a wide range of honing conditions in plateau honing and other honing applications. The present honing tools are also free of adhesives so as to be suitable for use in chemically and thermally hostile environments.

The means of melting or softening the abrasive filament ends according to the present invention preferably include applying energy to the holder or support member by means such as induction heating. Induction heating is preferred because it can be precisely controlled and it selectively heats only electrically conductive objects by exposing them to a powerful high frequency reversing magnetic field. Electrically non-conductive objects are not affected by induction heating. The holder, which is an electrically conductive member or at least includes some electrically conductive component therein for heating purposes, can be precisely heated by the induction heating process to raise the temperature thereof sufficiently to melt or at least soften the ends of any abrasive filaments located in or in close proximity thereto. Importantly, the abrasive filaments, which are electrically non-conductive, are heated only by their proximity to the induction heating operation such that the ends of the filaments in contact with or close to the heated holder are melted or softened while the opposite or work engaging ends of the filaments extending out of the holder are relatively unaffected by the heating process. The filament ends are molded or formed to the shape of the retaining means while in the softened state, and any spaces or voids between the filaments are eliminated by pressing the filaments into the cavity. When cooled and resolidified, the abrasive filaments are retained in the holder by engagement with the retaining means.

The holder or support member is made from an electrically conductive material such as a diecast metal or the like, or at least includes some electrically conductive material therein, to facilitate induction heating thereof. The holder can have any desired shape and size, preferably an elongated shape and a size suitable for mounting on a honing mandrel. The holder can include any number of cavities or receptacles for receiving one or more abrasive filaments, each of the cavities including means associated with a sidewall portion shaped for retaining the filaments in the cavity. The retaining means can comprise any structure suitable for engaging and retaining the filaments, such as a step, a groove or a reverse taper formed in one or more of the sidewalls for receiving and holding the melted or softened portion of the filaments. The retaining means can also include one or more tapered sidewall portions forming a dovetail shape to make the cavity smaller adjacent the open side for retaining the abrasive filaments. Other wall shapes are also possible.

The abrasive filaments for the present honing tools can be selected from the wide variety of commercially available abrasive filaments. These abrasive filaments are pliable or malleable when heated and are typically made from an electrically non-conductive material, such as nylon or the like, and include abrasive particles dispersed throughout which are sufficiently non-conductive so that the filaments wont be directly heated during the induction heating operation. This electrical non-conductivity is particularly important as it enables the mounted ends of the filaments to be located in the cavity of the holder during the heating operation and be melted or softened by proximity to the heated holder, while the opposite ends of the filaments extend out of the holder and remain relatively unheated. The filaments can also be inserted into the holder after heating as long as sufficient heat is present to melt or soften the ends of the filaments as desired.

OBJECTS OF THE INVENTION

A principal object of the present invention is to provide better and more effective honing tools over a wide range of honing conditions including for plateau and other like honing applications.

Another object is to provide stronger and more durable abrasive filament honing tools.

Another object is to provide abrasive filament honing tools which can be used in environments hostile to adhesives.

Another object is to provide improved means for making abrasive filament honing members which eliminate the use of adhesives, clamping, crimping and other such means for mounting the abrasive filaments.

Another object is to provide an improved method for making abrasive filament honing tools which is relatively inexpensive, simple, and adaptable for mass production.

These and other objects and advantages of the present invention will become apparent to those skilled in the art after considering the following detailed specification in conjunction with the accompanying drawings wherein;

DETAILED DESCRIPTION OF THE PREFERRED EMBODIMENTS

Figure 1:
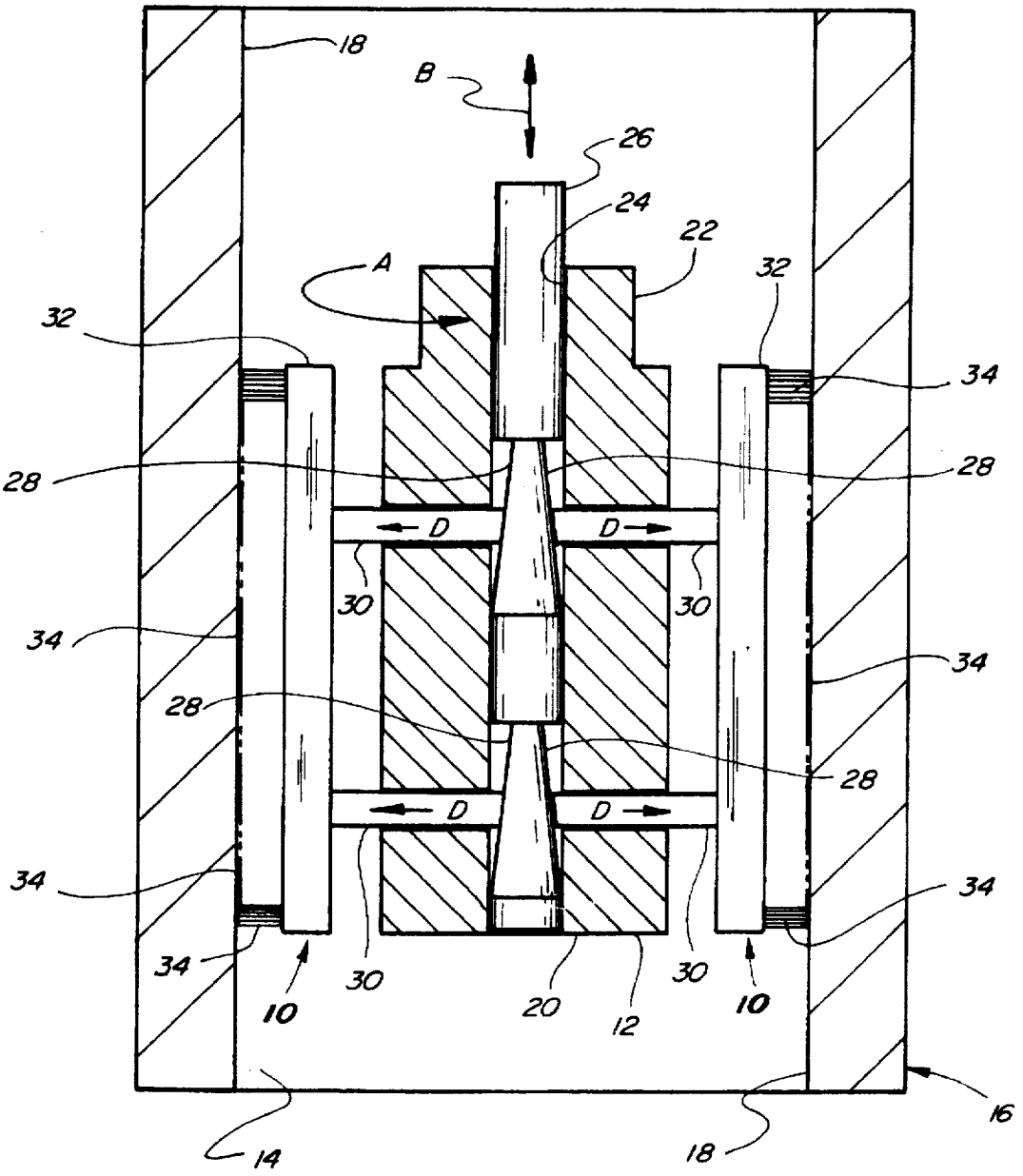
FIG. 1 is a partial cross-sectional view of a honing mandrel construction employing abrasive filament honing tools according to the present invention shown mounted thereon in position for honing surface of a bore.

Referring to the drawings more particularly by reference numbers wherein like numerals refer to like parts, the number 10 in FIG. 1 refers to one embodiment of an abrasive filament honing tool constructed according to the teachings of the present invention. The abrasive filaments of the tools 10 include corresponding ends which are melted or softened and molded to the shape of retaining means on the tool, preferably by an induction heating process, instead of being glued, crimped or clamped in place as in prior constructions. A plurality of the present abrasive filament honing tools 10 are shown mounted on an expandable honing mandrel 12 located in a bore 14 of a workpiece 16 in position for honing the surface 18 of the bore. This is a set up typical of plateau honing and like applications wherein the honing mandrel 12 is mounted on a honing machine (not shown) which rotates the honing mandrel (designated by the letter A) about the axis of the bore 14, moves it reciprocally (designated by the letter B) along the bore axis, and applies radially outwardly directed pressure (designated by the letter D) through the honing tools 10 against the bore surface 18 to remove material therefrom. The honing mandrel 12 is representative of a wide variety of conventional honing mandrel constructions, but a long with the honing machine itself, does not form part of the present invention. Nonetheless, the honing mandrel 12 includes an elongated body member 20 having one end 22 for mounting on a honing machine and a central longitudinal bore 24 extending therethrough. The honing mandrel 12 includes an elongated adjusting rod or operating member 26 axially operable in the bore 24 by the action of the honing machine. The operating member 26 has wedge shaped outer surface portions 28 which slidably engage the ends of rod members 30 on which the honing tools 10 are mounted for radially extending and retracting the honing tools by the axial movement of the adjusting member 26, and for applying the honing pressure by the honing tools against the bore surface 18.

Figure 2:
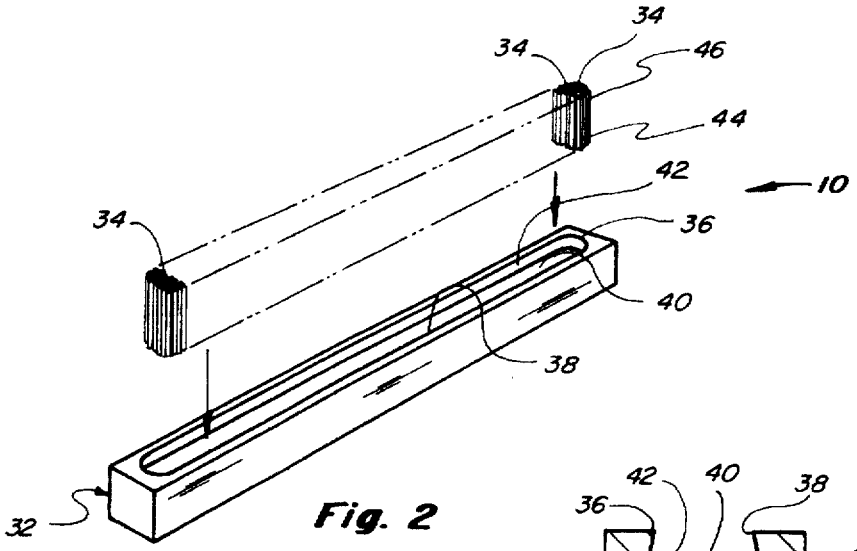
FIG. 2 is perspective view of one of the abrasive filament honing tools of FIG. 1 with the abrasive filaments removed to show the cavity in the holder for receiving the abrasive filaments.
Figure 3:
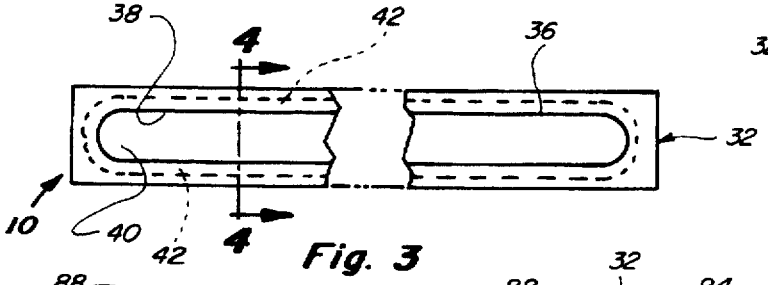
FIG. 3 is a top plan view of the holder of FIG. 2 showing the cavity opening.

The abrasive filament honing tools according to the present invention can be made in a wide variety of sizes and shapes for different honing applications and are consumable members that can be discarded when worn out. The present tools can utilize abrasive filaments having different sizes, shapes and abrasive compositions for a wide variety of honing applications. Each of the abrasive filament honing tools 10 includes an elongated holder or support member 32 having a plurality of elongated abrasive filaments 34 mounted thereon in generally parallel, closely packed relation. The holder 32 also includes means (not shown) for mounting on the honing mandrel. Referring to FIGS. 2–3, the holder 32 includes an elongated open sided cavity or receptacle 36 formed in one side thereof for receiving the abrasive filaments 34. The cavity 36 includes a cavity opening 38, an opposite bottom surface or floor 40, and a sidewall 42 which extends around the cavity between the cavity opening 38 and the floor 40. The cavity 36 has a depth, measured along the sidewall 42 from the cavity opening 38 to the floor 40, sufficient for cooperatively receiving the corresponding mounting ends 44 of the abrasive filaments 34 such that the opposite or work engaging ends 46 of the filaments will extend outwardly a uniform distance from the cavity opening 38, as shown in FIG. 1.

Figure 4:
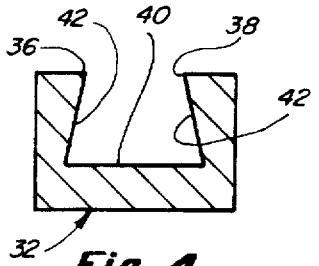
FIG. 4 is a cross, sectional view of the holder taken along lines 4—4 of FIG. 3 showing the tapered sidewalls the cavity for retaining the abrasive filaments in the cavity.
Figure 5:
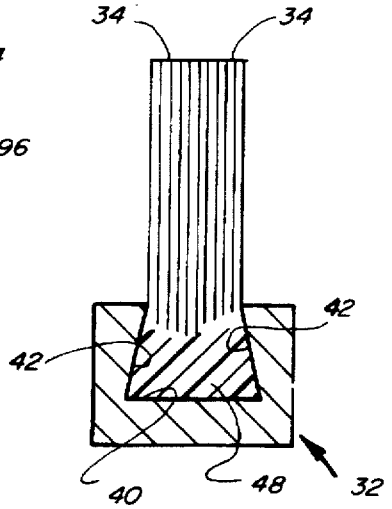
FIG. 5 is another cross-sectional view of the holder showing the mounting ends of the abrasive filaments melted together and retained in the cavity by the tapered sidewalls.

Importantly, in this embodiment, the means for retaining the filament mounting ends 44 in the cavity 36 include the opposing portions of the sidewall 42. The opposing portion of the sidewall 42 are angled or tapered so as to make the cavity cross-section smaller adjacent the opening 38 and larger adjacent the floor 40. This shape, also known as a dovetail shape, is best shown in FIG. 4. The mounting ends 44 are melted or at least softened, preferably by the induction heating process discussed below, and are pressed into the cavity so as to be molded and conformed to this dovetail shape. In this regard, it is preferred that the mounting ends be melted sufficiently so as to be fused together into a solitary mass 48, as shown in FIG. 5. When allowed to cool and resolidify, the dovetail shaped mass 48 is retained in the cavity by intimate engagement with the opposing tapered sidewalls.

Figure 6:
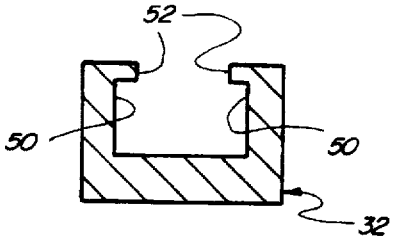
FIG. 6 is a cross-sectional view of an alternative holder embodiment having stepped cavity sidewalls for retaining the filaments.
Figure 7:
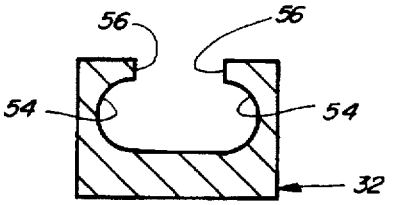
FIG. 7 is a cross-sectional view of an alternative holder embodiment having curved cavity sidewalls for retaining the filaments.

The holder 32, as well as the other holder embodiments according to the present invention, can include a wide variety of alternative retaining means. For instance, one variation is to provide opposing straight sidewall portions 50 with opposing step or flange means 52 associated therewith, as shown in FIG. 6, for retaining the filaments. FIG. 7 shows another alternative including opposing curved sidewall portions 54 forming recessed cavity portions spaced from the cavity opening and flange means 56 associated therewith for retaining the filaments. The flange means preferably extend around the entire cavity opening, but alternatively, can include members located at spaced positions around the opening, or a member or members located adjacent one side of the cavity, although these are not the preferred alternatives. Additional retaining means can include one or more longitudinally extending grooves formed in the sidewall, or pins or other members inserted through the sidewall and engaged with the solitary mass of filaments 48.

Figure 8:
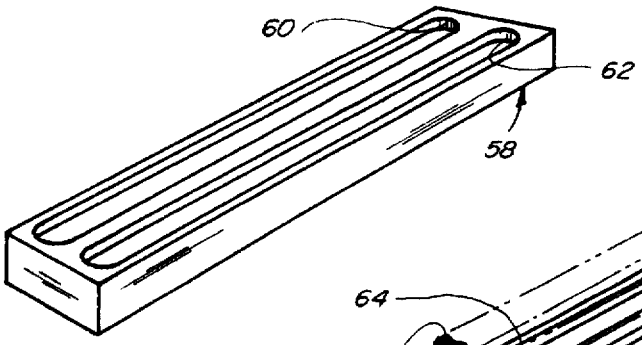
FIG. 8 is a perspective view of an alternative holder embodiment having two cavities for receiving abrasive filaments.
Figure 9:
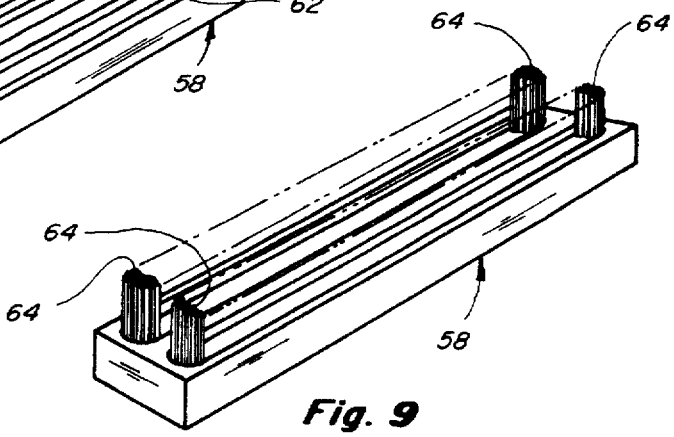
FIG. 9 is a perspective view of the holder of FIG. 8 with a plurality of abrasive filaments mounted thereon.
Figure 10:
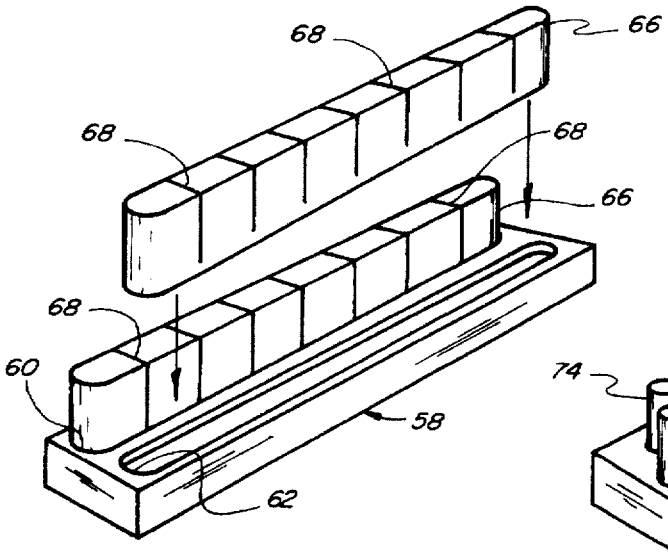
FIG. 10 is a perspective view of the holder of FIG. 8 showing an alternative abrasive filament construction.
Figure 12:
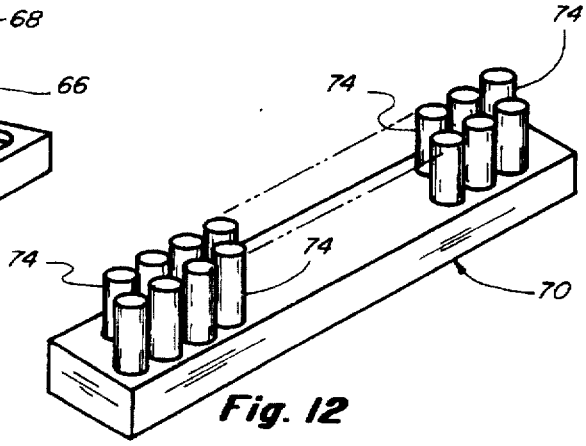
FIG. 12 is a perspective view of the holder of FIG. 11 showing individual abrasive filaments mounted in the cup shaped receptacles.
Figure 11:
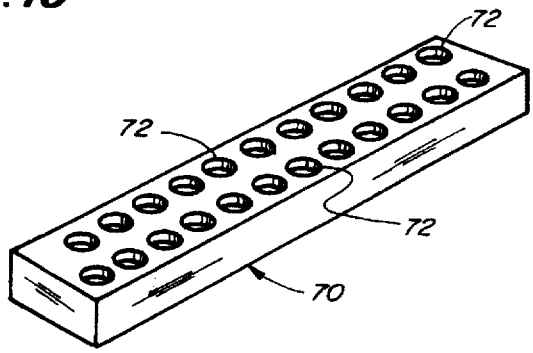
FIG. 11 is a perspective view of an alternative holder embodiment having a plurality of cup shaped receptacles receiving abrasive filaments.

Alternative holder constructions according to the present invention can include holders having more than one cavity and cavities of the same or of different shapes for receiving any number of abrasive filaments. FIG. 8 shows one alternative holder construction 58 having two parallel, elongated cavities 60 and 62. The holder 58 can be used for holding any number of abrasive filaments and can include any of the various means according to the present invention for retaining the filaments in the respective cavities 60 and 62. For instance, FIG. 9 shows the holder 58 with a plurality of abrasive filaments 64. FIG. 10 shows the holder 58 with much larger abrasive filaments 66. In this embodiment, the filaments 66 are inserted into the cavities 60 and 62 in lengthwise rows and the sides of the filaments inserted in to the cavities are melted and conformed to the shape of the respective cavities. The filaments 66 can optionally include slits 68 therethrough at intervals along the length thereof. FIG. 11 shows still another alternative holder 70 which includes a plurality of cup shaped cavities or receptacles 72 having round or oval openings. Each of the cup shaped cavities 72 can receive one or more abrasive filaments, such as the single abrasive filaments 74 shown in FIG. 12. The mounting ends of the filaments 74 are melted or softened and molded to the shape of the cavity in the manner discussed above.

An important object of the present invention is to provide the capability for melting or softening the mounting ends of the abrasive filaments to enable conforming them to the shape of a cavity or receptacle on a holder such that at least some of the filament ends intimately engage the sidewall of the cavity, while having as little effect as possible on the opposite or work engaging ends of the filaments. This enables the work engaging ends to remain as separate, discrete members to provide the honing characteristics and advantages afforded by honing with individual abrasive filaments. To provide this capability, it has been found that applying energy to the filament holder or support member instead of directly to the filaments themselves enables precisely controlling the portion of the filament which is heated. In this regard, it has been found that a process wherein the holder or support member is heated by induction is most satisfactory. Briefly stated, induction heating raises the temperature of electrically conductive objects, but has no direct effect on electrically non-conductive members. To facilitate the induction heating process, the holder or support member, whatever form it may take, is made from an electrically conductive material, such as machined, diecast or other metal. The abrasive filaments, on the other hand, are made from an electrically non-conductive material so as not to be directly heated by the induction heating process.

Figure 13:
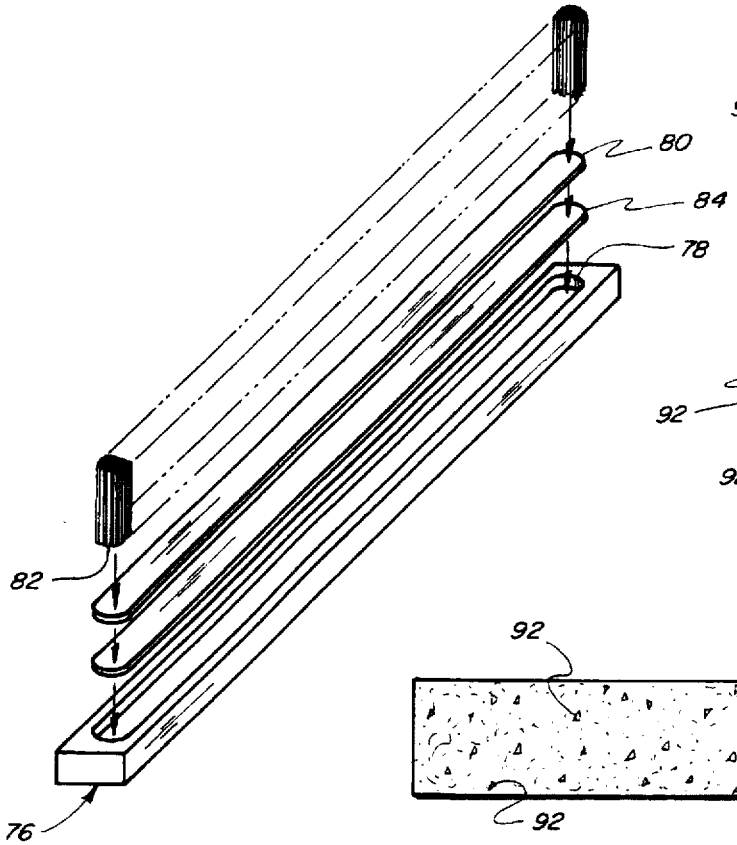
FIG. 13 is a perspective view of an alternative electrically nonconductive holder embodiment showing an electrically conductive member and an insulating member in association therewith as well as a plurality of abrasive filaments.

Alternatively, the holder can be made from an electrically non-conductive material such as plastic, as long as some electrically conductive means for melting the mounted ends of the abrasive filaments are provided. Referring to FIG. 13, one alternative holder construction 76 is shown which is made from a non-conductive plastic material having a melting point greater than the melting point of the abrasive filaments, which is typically about 500 degrees Fahrenheit as stated below. The holder 76 includes a single cavity 78. To provide the electrical conductivity required for the induction heating process, the holder 76 includes an electrically conductive member or strip 80 which can be made from metal or the like and is located in the bottom of the cavity 78 so as to be in contact with the mounting ends of the plurality of abrasive filaments 82 for melting the mounting ends. An optional thermally insulating electrically non-conductive member or strip 84 can be located between the member 80 and the holder 76 to direct more of the heat towards the filaments and prevent unintended heating of the holder.

Figure 14:
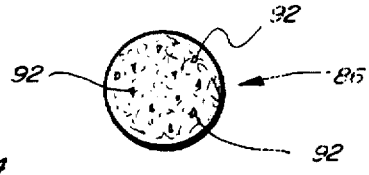
FIG. 14 is an enlarged end view of an abrasive filament having a round cross-sectional shape.
Figure 15:
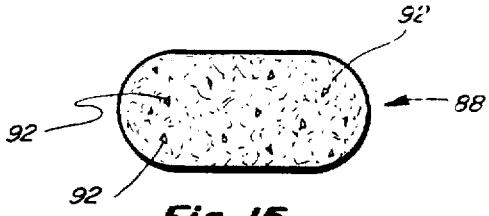
FIG. 15 is an enlarged end view of an alternative abrasive filament having an oval cross-sectional shape.
Figure 16:
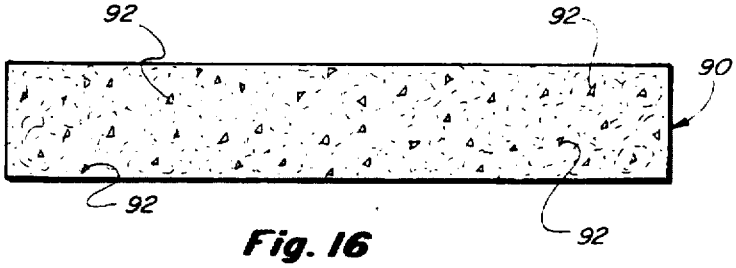
FIG. 16 is an enlarged end view of an alternative abrasive filament having a rectangular cross-sectional shape.

The abrasive filaments utilized in the present invention can be selected from any of a variety of commercially available abrasive filaments. Typical abrasive filaments suitable for use with the present invention can include, but are not limited to, those formed from a continuous strand of monofilament synthetic polymeric material having particles of abrasive dispersed throughout the strand and cut to a desired length. Synthetic materials used for the filaments can include nylons, polystyrenes, polyvinylchlorides, polyesters, polypropylenes, polyethylenes and polyetheretherketone, nylon being one of the most commonly available materials and also one that is preferred. The abrasives dispersed throughout the filaments can be selected from any of those typically used for honing such as particles of silicon carbide, aluminum oxide, diamond or cubic boron nitride. The abrasives can also include those less often used for honing, such as particles of natural carborundum, topaz, quartz, feldspar, apatite, fluorite, calcite, gypsum, talc and pumice as well as other materials. The abrasive filaments can have a wide variety of cross-sectional shapes such as a round shape 86 (FIG. 14); an oval or oblong shape 88 (FIG. 15); a rectangular shape 90 (FIG. 16); or a square or other desired shape. The abrasive filaments typically vary in size from about 0.01 inch in diameter for round and oval filaments, to about 0.125 inch by 0.375 inch or larger for rectangular filaments. The filaments typically have an abrasive particle content from about 20 to 40 percent by volume which has been found to be satisfactory for most plateau honing and like honing applications, and the abrasive particles, such as the particles 92 in the filaments 86, 88 and 90 of FIGS. 14–16, are randomly dispersed throughout the filaments. The filaments are pliable members which are softenable and meltable when subjected to the appropriate temperature. The melting temperature of the filaments is typically below about 500 degrees Fahrenheit.

Figure 18:
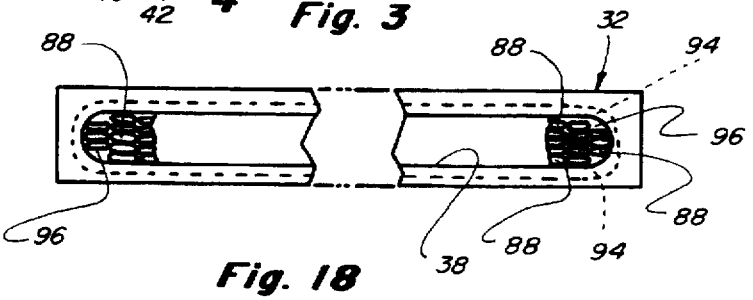
FIG. 18 is a top plan view of the holder of FIG. 6 with a plurality of oval abrasive filaments located in the cavity thereof.
Figure 17:
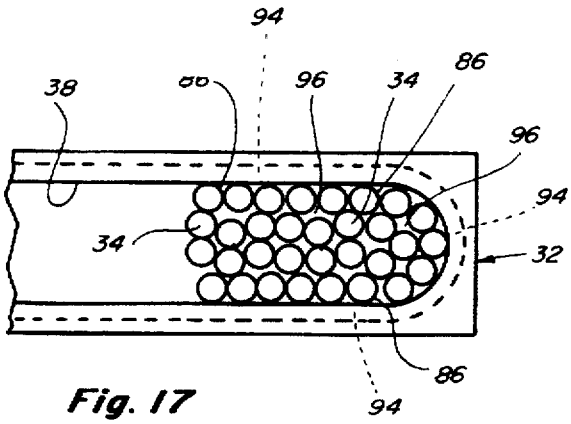
FIG. 17 is an enlarged fragmentary top plan view of the holder of FIG. 6 with a plurality of abrasive filaments located in the cavity thereof before heating to show the space between the abrasive filaments and the sidewall and the interstices between the individual filaments.

Any number of abrasive filaments having the above-described cross-sectional shapes as well as other shapes can be packed in closely spaced relation in a single cavity of a holder to provide the advantages of more even honing and longer tool life by paying close attention to the arrangement of the filaments in the cavity. For instance, reference is made to FIG. 17 which shows the arrangement of a plurality of the round abrasive filaments 86 closely packed together in the holder 32 of FIG. 6 to provide maximum filament density. FIG. 18 shows a large number of the oval or oblong shaped filaments 88 packed together in the holder 32. In each of these examples, the arrangement is selected such that the cavity can be packed to the maximum capacity of the cavity opening 38. However, because the cavity cross-section is smaller adjacent the cavity opening 38 than adjacent cavity floor 40 (shown by the dotted line), a space 94 resulting from the cavity geometry remains between the sidewall and the filaments. Furthermore, a plurality of interstices 96 exists between the individual filaments themselves. The space 94 and that portion of the interstices 96 located in the holder should be eliminated as much as possible during melting to ensure good retention of the filaments in the holder. This is accomplished by pressing the filaments into the cavity as the mountings ends are melted or softened. This causes the mounting ends to be deformed and molded to the shape of the cavity, thereby filling any voids or spaces in the cavity.

Apparatus for the induction heating process includes a transformer or inductor coil (not shown). According to well known principles of induction and magnetism, this transformer or induction coil creates a high frequency reversing magnetic field in close proximity thereto when energized. Any electrically conductive object in this high frequency reversing magnetic field will be quickly heated to a very high temperature by exposure to the field. By selecting a holder or support member made from an electrically conductive material or at least including an electrically conductive member therein, and exposing the holder to a high frequency reversing magnetic field, the holder or at least the electrically conductive portion thereof is heated to a temperature equal to or greater than the melting point of the abrasive filaments and maintained at that elevated temperature as long as required.

Using the fixturing devices discussed below or other suitable apparatus, the mourning ends of the abrasive filaments can be located in the cavity of the holder as it is heated, or can be inserted into the already heated holder and melted or at least softened by contact with/or proximity to the holder. Importantly, the opposite ends of the filaments are not melted because they are not electrically conductive and they are not sufficiently close to the holder to be adversely affected by the temperature thereof. In cases where a plurality of filaments are located in the same cavity, the mounting ends of the filaments can be melted together into a solitary mass which provides the advantages discussed above. As the ends of the filaments in contact with or closest to the hot surfaces of the cavity are melted or softened, the filaments are pressed or rammed further into the cavity so as to fill the space 94 and the interstices 96 and completely fill the cavity. When allowed to cool and harden, the filaments will be securely and firmly held in place in the holder. Additional steps, which are optional, can include dressing or cutting all of the filaments to a precise, uniform length, as well as other finishing operations.

Figure 19:
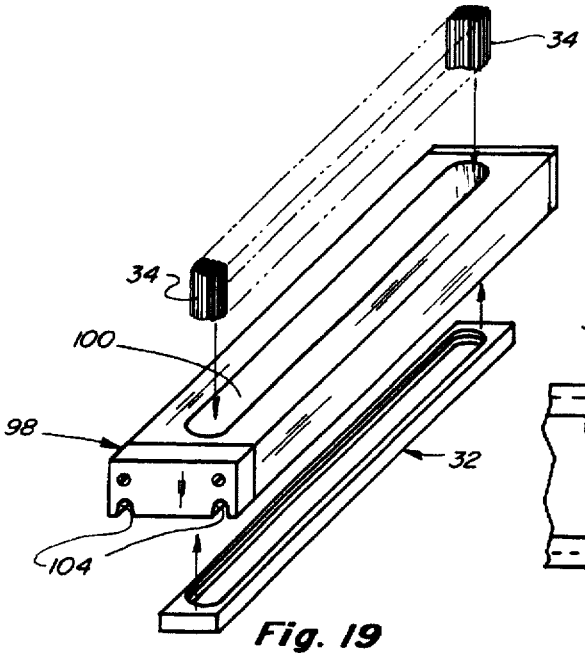
FIG. 19 is a perspective view of a holding fixture for induction heating in association with a plurality of abrasive filaments and the holder of FIG. 6.
Figure 20:
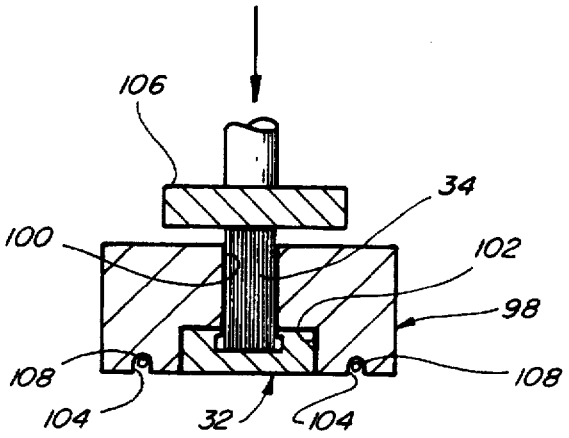
FIG. 20 is a cross-sectional view of the holding fixture of FIG. 19 showing the holder mounted therein, the abrasive filaments in place in the holder cavity, and a ram in a first position spaced from the holder for pressing the filaments into the cavity.
Figure 21:
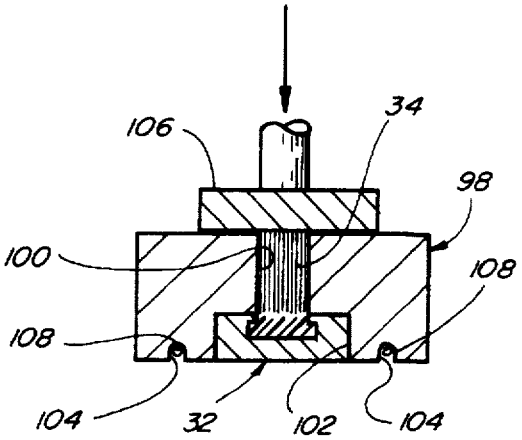
FIG. 21 is another cross-sectional view of the holding fixture and holder of FIG. 19 showing the ends of the abrasive filaments melted into a solitary mass and the ram in a second position against the holding fixture.

The preferred apparatus for holding and positioning the filaments in the holder or support member during the induction heating process is the holding fixture 98 shown in FIGS. 19–21. The holding fixture 98 is an elongated member made from a relatively rigid, electrically non-conductive material such as phenolic which is relatively un-affected by the magnetic field created by the induction heating operation. Phenolic is also a desirable material because it has a melting temperature higher than that of the abrasive filaments so it wont be melted or otherwise be adversely affected by contact with the holder when heated. The holding fixture 98 includes an elongated filament slot or passage 100 extending therethrough for receiving and holding or supporting a plurality of abrasive filaments, which filament slot 100 corresponds in size and shape to the opening of the selected holder. The holding fixture 98 has an elongated recess 102 sized and shaped for receiving the selected holder such as the holder 32, and a pair of elongated channels 104 extending in parallel relation to the recess 102 adjacent either side thereof for receiving portions of a single loop induction heating coil 108 (FIGS. 20 and 21 ).

Importantly, the length of the abrasive filaments should be selected such that the filaments are a predetermined amount longer than the thickness of the fixture 98 as measured from the top surface thereof through the slot 100 to the recess 102. This is to provide enough extra filament material to enable the filaments to fill the space 94 and the interstices 96 when the filaments are pressed into the holder. Formulae for determining how the proper filament length for this purpose is determined are set forth below. Any suitable means for uniformly pressing or feeding the abrasive filaments into the holder can be utilized, such as the ram 106. The ram 106 includes an elongated member having a flat surface for engaging the ends of the abrasive filaments as shown, and means such as an air cylinder or the like (not shown) for advancing the flat surface member against the ends of the filaments.

In operation, with a holder such as the holder 32 of FIG. 6 loaded in the recess 102 of the holding fixture 98, a induction coil 108 in place in the channels 104, and a plurality of abrasive filaments such as the filaments 34 loaded in the slot 100 with the ram 106 in position against the filaments, the induction coil can be energized to heat the holder 32. Using a typical induction heating coil, the holder can be heated to 500 degrees Fahrenheit or so in about 10 to 15 seconds. Because they are electrically non-conductive, the fixture and the portions of the abrasive filaments not contacting or in close proximity to the holder are not heated and remain relatively cool to the touch. However, the ends of the filaments in contact with the holder are heated and melted by thermal conduction from the holder. Light pressure applied against the filaments by the ram 106 is then used to press the filaments into the holder such that the filaments fill the cavity when the ram reaches the fixture 98, which typically can take about 3 seconds. The filaments then solidify in about 5 seconds and the holder with filaments mounted thereon can be removed from the fixture and the holder quenched by immersing in water or otherwise cooled to enable the newly formed tool to be handled.

Figure 22:
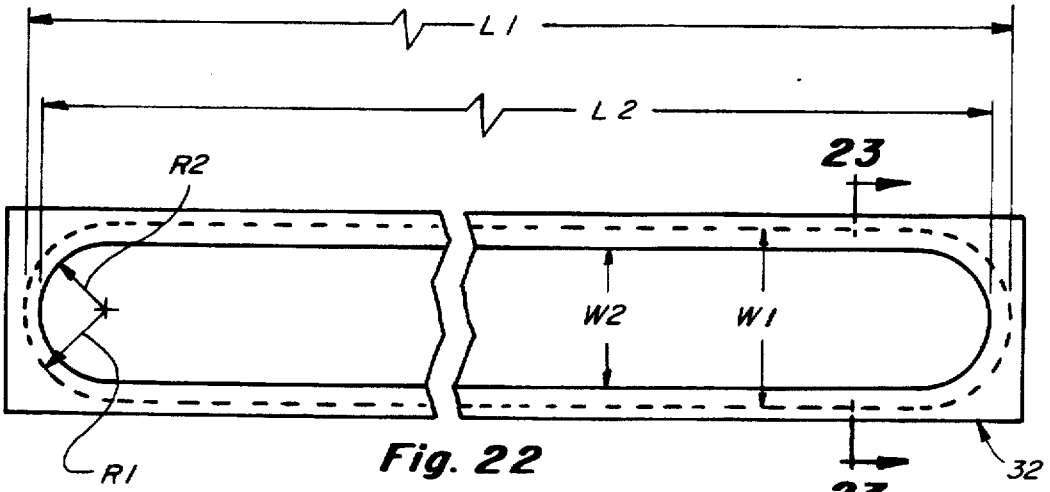
FIG. 22 is an enlarged top plan view of the holder of FIG.6 showing the length, width and radius dimensions thereof.
Figure 23:
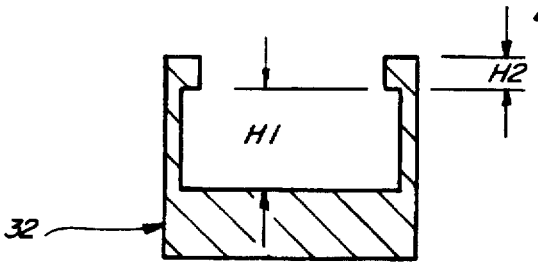
FIG. 23 is a cross-sectional view of the holder of FIG. 6 showing the height dimensions thereof.

Referring to FIGS. 22 and 23, the holder 32 of FIG. 6 used in the example above is shown including the dimensions necessary for determining the additional filament length to provide the proper amount of material to fill the voids 94 and 96. The additional filament height to fill these voids is designated by the letter F and can be calculated as follows:

$$F=V2/A1$$

Where:

L1=lower cavity floor length

W1=lower cavity floor width

R1=lower cavity floor end radius

H1=lower cavity height

L2=upper cavity length

W2=upper cavity width

R2=upper cavity end radius

Af=cross sectional area of single filament

N1=number of filament to fill cavity

R3=round filament radius volume of cavity=$V1=((L1)(W1)+(\pi)(R1)^2)H1+((L2)(W2)+(\pi)(R2)^2)\ H2$ area of filaments=$A1=\pi(N1)(R3)^2$ volume of voids=$V2=V1-(A1)(H1+H2)$ The value F also represents the downfeed travel of the ram 106 necessary to fill the voids 94 and 96. As an alternative to calculating the required filament length F and cutting the filaments to this exact length before inserting into the holder, filaments could be used which are sufficiently long to provide material for filling the space between the holder and the filaments and the interstices between the filaments with length to spare. The filaments can then be trimmed to the desired finished length after mounting.

Thus there has been shown and described several embodiments of a novel abrasive filament honing tool and methods for manufacturing same which fulfill all of the objects and advantages set forth above. It will be apparent to those skilled in the art, however, that many changes, modifications, variations and other uses and applications for the subject invention are possible. All such changes, modifications, variations and other uses and applications which do not depart from the spirit and scope of the invention are deemed to be covered by the invention which is limited only by the claims which follow.

What is claimed is:

1. A honing tool comprising a metal holder of unitary construction having a cavity located in one side thereof, the cavity having one open side of known cross-section, the holder having a bottom surface in the cavity opposite the open side, and a sidewall extending around said cavity between the open side and the bottom surface, the sidewall having at least one recessed portion forming at least one recessed cavity portion in communication with the cavity at a location spaced from the open side, the recessed sidewall portion having a portion that faces at least partially away from the open side of the cavity, and at least one filament of a polymeric material having particles of an abrasive substance dispersed throughout, said at least one filament having an overall cross-section corresponding generally to the cross-section of the open side of the cavity and said at least one filament having one end which extends outwardly from the open side of the cavity and an opposite end located in the cavity, the end of the at least one filament located in the cavity forming a solitary mass that substantially fills said cavity including said at least one recessed cavity portion and intimately engages and conforms to said at least one recessed sidewall portion so as to be retained in the cavity thereby.

2. The honing tool according to claim 1 wherein said at least one filament comprises a single filament.

3. The honing tool according to claim 2 wherein the end of the filament which extends outwardly from the open side of the cavity is slitted to form a plurality of discrete filament portions.

4. The honing tool according to claim 2 wherein the cross-section of the open side of the cavity is elongated, and the single filament has a corresponding elongated longitudinal cross-section and is oriented so as to extend longitudinally in the open side of the cavity.

5. The honing tool according to claim 1 wherein the at least one filament comprises a plurality of filaments.

6. The honing tool according to claim 1 wherein the sidewall has a single recessed portion extending around the cavity.

7. A method for manufacturing a honing tool, the honing tool comprising an integrally formed metal holder having a cavity with an open side of known cross-section formed in one side thereof, the holder having a bottom surface in the cavity opposite the open side and a sidewall extending around the cavity between the open side and the bottom surface, the sidewall including at least one recessed portion at a location spaced from the open side of the cavity defining a cavity portion of larger cross-section than the cross-section of the open side, each recessed sidewall portion including a portion in communication with the larger cross-section cavity portion facing at least partially away from the open side of the cavity, and at least one filament of a polymeric material that melts at a known temperature having particles of an abrasive dispersed throughout, the at least one filament having first and second opposite ends and an overall cross-section corresponding generally to the cross-section of the open side of the cavity, said method comprising the steps of:

a) heating the holder by induction to at least said known temperature;

b) holding the first end of the at least one filament and inserting the second end thereof into the cavity of the heated holder such that just said second end is melted by the heated holder into a unitary mass;

c) pressing the at least one filament deeper into the cavity such that the unitary mass substantially fills the cavity including the larger cross-section cavity portion and intimately engages the portion of the at least one recessed sidewall portion facing away from the open side of the cavity; and d) allowing the holder to cool such that the unitary mass is hardened and retained in the cavity by the engagement thereof with the portion of the at least one recessed sidewall portion facing away from the open side of the cavity.

8. The method according to claim 7 wherein the known temperature is about 500° F.

9. The method according to claim 7 wherein the at least one filament comprises a single filament.

10. The method according to claim 9 comprising the further step wherein the first end of the single filament is slitted to form a plurality of discrete filament portions.

11. The method according to claim 7 wherein the at least one filament comprises a plurality of filaments.

12. The method according to claim 11 wherein the plurality of filaments are bundled together in closely packed relation.

13. The method according to claim 7 wherein the holder cavity has a known volume, the at least one filament has a known volume per unit of length, and a length of the at least one filament corresponding to the volume of the cavity is inserted and pressed into the cavity to fill the cavity.

14. The method according to claim 7 wherein the at least one recessed sidewall portion includes opposed sidewall portions adjacent opposite sides of the cavity extending convergingly towards the open the side thereof.

15. The method according to claim 7 wherein the sidewall forms a step intermediate the open side of the cavity and the larger cross-section cavity portion.

16. The method according to claim 7 wherein the holder and the cavity are elongated.

17. The method according to claim 7 comprising a plurality of said cavities in spaced relation to one another formed in one side of the holder.

18. A method for manufacturing a honing tool for mounting on a honing machine, the honing tool including a unitary metal holder having an open sided cavity formed in one side thereof, a bottom surface in the cavity opposite the open side, and a sidewall extending around the cavity between the open side and the bottom surface, the sidewall having at least one recessed portion spaced from the open side of the cavity forming a recessed cavity portion, each recessed sidewall portion including a portion adjacent the recessed cavity portion formed thereby facing at least partially away from the open side of the cavity, and a plurality of filaments of a polymeric material that melts at a known temperature having particles of an abrasive dispersed throughout, said filaments having first and second opposite ends, said method comprising the steps of:

a) heating the holder by induction to at least said known temperature;

b) holding the first ends of the filaments and inserting the second ends of the filaments into the cavity of the heated holder such that just the second ends of the filaments are melted together into a solitary mass in the cavity by the heated holder;

c) pressing the filaments farther into the cavity to force the solitary mass against the bottom wall such that the mass spreads sidewardly into the at least one recessed cavity portion and substantially fills the cavity and intimately engages the portion of the at least one recessed sidewall portion facing away from the open side of the cavity; and d) allowing the holder and the solitary mass to cool such that the solitary mass is hardened and retained in the cavity by the engagement thereof with the portion of the at least one recessed sidewall portion facing away from the open side of the cavity.

19. The method according to claim 18 wherein each recessed cavity portion of the holder has a known volume, the plurality of filaments have a known volume per unit of length as measured between the first and second opposite ends thereof, and the filaments are pressed farther into the cavity by a length thereof corresponding to the total recessed cavity portion volume.

20. The method according to claim 18 wherein the holder and cavity are elongated and the sidewall includes a continuous recessed portion extending around the cavity.

* * * * *